US006266504B1

(12) United States Patent
Katoh

(10) Patent No.: US 6,266,504 B1
(45) Date of Patent: Jul. 24, 2001

(54) DEVELOPING APPARATUS AND IMAGE FORMING APPARATUS

(75) Inventor: Tetsuo Katoh, Kunitachi (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/501,212

(22) Filed: Feb. 10, 2000

(51) Int. Cl.[7] ..... G03G 15/08
(52) U.S. Cl. ..... 399/256; 366/319; 399/281
(58) Field of Search ..... 399/254, 256, 399/255, 272, 281; 366/297, 319, 322, 325.92, 325.1

(56) References Cited

U.S. PATENT DOCUMENTS 4,202,636 * 5/1980 Vanderveen ..... 366/319
4,974,023 * 11/1990 Aimoto et al. .
4,980,724 * 12/1990 Tanaka .
5,204,721 * 4/1993 Sharpe .
5,249,019 * 9/1993 Ishida et al. .
5,603,568 * 2/1997 Mobley et al. ..... 366/196
5,842,090 * 11/1998 Mikawa ..... 399/256
6,099,159 * 8/2000 Yoshida et al. ..... 366/156.1

FOREIGN PATENT DOCUMENTS 54-30838 3/1979 (JP) .

* cited by examiner

*Primary Examiner*—Sandra Brase
(74) *Attorney, Agent, or Firm*—Foley & Lardner

(57) ABSTRACT

A developing apparatus faces an image carrier carrying an electrostatic latent image and comprises a developing section for developing the electrostatic latent image by supplying a developing agent thereto and a feeding section for feeding the developing agent to the developing section while stirring. The feeding section has a rotatable shaft member, a blade body formed spirally on an outer peripheral surface of the shaft member for feeding the developing agent in a shaft direction, and a plurality of projections located between tilted blade portions on the outer peripheral surface of the shaft member. The projections, each being placed at an interval from the tilted blade portions of the blade body and are arranged at predetermined intervals along circumference of the shaft member.

15 Claims, 5 Drawing Sheets

DEVELOPING APPARATUS AND IMAGE FORMING APPARATUS

BACKGROUND OF THE INVENTION

The present invention relates to a developing apparatus to be installed in an electrophotographic copying machine, a developing method, and an image forming apparatus.

In the developing apparatus of this type, a two-component developing agent made of a carrier and a toner is fed to a developing roller while stirring and circulating it with the aid of rotation of the feed mixer. The developing agent fed to the developing roller is further supplied to an electrostatic latent image formed on a photosensitive drum by the aid of rotation of the developing roller. In this way, the latent image is developed.

The feed mixer of the developing apparatus has a shaft member which has a spiral-form blade body for feeding the developing agent in a shaft direction. To the shaft member of the feed mixer, a paddle is horizontally fitted for scraping the developing agent upwardly to the position at which the developing roller is located.

The developing apparatuses includes a face-side type and a face-up type. In the face-side type, a developing roller is placed at a side of the photosensitive drum so as to face a side surface portion of the photosensitive drum. In the face-up type, the developing roller is placed under the photosensitive drum so as to face a lower surface of the photosensitive drum.

In the case of the face-up type developing apparatus, since the photosensitive drum is placed above the developing apparatus, the fixing position of a doctor blade is lowered in such a manner that the doctor blade for regulating a thickness of a layer of the developing agent formed on the developing roller is not in contact with the photosensitive drum. With this arrangement, the fixing position of the feed mixer is lowered. As the result, the position of the developing roller is placed higher than a center shaft of the feed mixer. Therefore, in the case of the face-up developing apparatus, it is necessary to increase the function of the feed mixer for scraping the developing agent upward, compared to the face-side developing apparatus.

Then, in a conventional type, the area of the paddle is enlarged by increasing a width of the paddle to improve the scraping-up function of the paddle.

However, if the scraping-up function of the feed mixer is simply increased, the ability for feeding the developing agent in a shaft direction is lowered, with the result that a speed for circulating the developing agent decreases. If the circulation speed decreases, the image is formed non-uniformly in concentration particularly in the case where a copy speed is high or where a printing rate is high.

BRIEF SUMMARY OF THE INVENTION

The present invention was made in the aforementioned circumstances. An object of the present invention is to provide a developing apparatus, a developing method, and an image forming apparatus satisfying the requirements for a circulating speed and scraping ability of the developing agent.

The developing apparatus of the present invention comprises developing means facing an image carrier for carrying an electrostatic latent image, for developing the electrostatic latent image by supplying a developing agent thereto;

feeding means for feeding the developing agent to the developing means while stirring;

the feeding means comprising a rotatable shaft member a blade body spirally formed on an outer peripheral surface of the shaft member, for stirring the developing agent in a shaft direction; and a plurality of projections arranged at the outer peripheral surface of the shaft member between tilted blade portions of the blade body, for scraping the developing agent upwardly toward the developing means, the plurality of projections, each being placed at an interval from the tilted blade portions of the blade body and are arranged at predetermined intervals along circumference of the shaft member.

The developing method of the present invention comprises the steps of developing an electrostatic latent image carried on an image carrier by supplying a developing argent by a developing member; and feeding the developing argent by a feeding member to the developing member while stirring, the feeding member comprising a rotatable shaft member a blade body spirally formed on an outer peripheral surface of the shaft member; and a plurality of projections arranged at the outer peripheral surface of the shaft member between tilted blade portions of the blade body, the plurality of projections, each being placed at an interval from the tilted blade portions of the blade body and are arranged at predetermined intervals along circumference of the shaft member and scraping the developing agent upwardly toward the developing means, at the same time the developing agent is fed while stirring in a shaft direction by rotation of the blade body.

The image forming apparatus of the present invention comprises image forming means for forming an electrostatic latent image corresponding to an image data on a image carrier;

developing means arranged under the image carrier for developing the electrostatic latent image formed by the image forming means by supplying a developing agent thereto; and transfer means for transferring a developing agent image developed by the developing means to a medium, the developing means comprising supply means arranged so as to face the image carrier for supplying the developing agent to the electrostatic latent image, thereby developing the electrostatic latent image;

feeding means for feeding the developing agent to the supply means while stirring the developing agent;

the feeding means comprising a rotatable shaft member a blade body spirally formed on an outer peripheral surface of the shaft member, for stirring the developing agent in a shaft direction; and a plurality of projections arranged at the outer peripheral surface of the shaft member between tilted blade portions of the blade body, for scraping the developing agent upwardly toward the developing means, the plurality of projections, each being placed at an interval from the tilted blade portions of the blade body and are arranged at predetermined intervals along circumference of the shaft member.

DETAILED DESCRIPTION OF THE INVENTION

Figure 1:
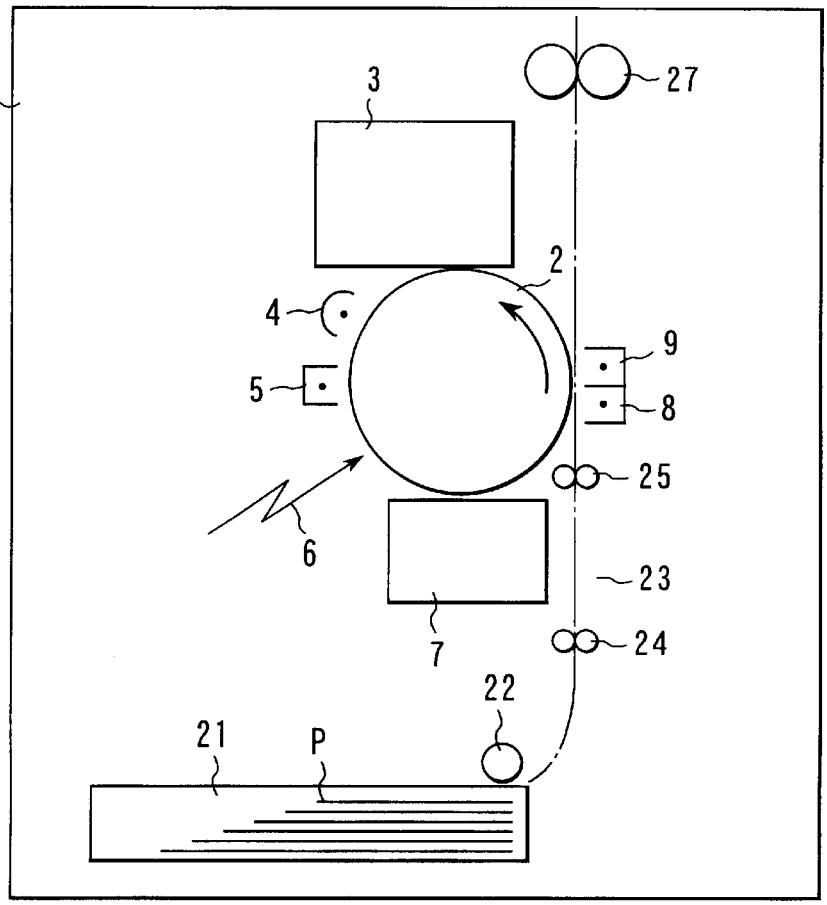
FIG. 1 is a schematic view showing a structure of an electrophotographic copying machine according to an embodiment of the present invention.

Now, the present invention will be explained with reference to embodiments shown in the drawings.

FIG. 1 is a schematic view showing a structure of an electrophotographic copying machine as an image forming apparatus according to an embodiment of the present invention.

In the figure, reference numeral 1 is a copying machine main body. At near the center portion of the copying machine main body 1, a photosensitive drum 2 serving as an image carrier is rotatably arranged. Over the upper surface portion of the photosensitive drum 2, a cleaning apparatus 3 for removing a magnetic toner left on the photosensitive drum 2 is arranged so as to face the photosensitive drum 2.

At one of the side portions of the photosensitive drum 2, a discharging charger 4 for removing a surface potential of the photosensitive drum 2, an electrifying charger 5 for charging the surface of the photosensitive drum 2 with a predetermined potential, and a light exposure portion 6 for forming a toner image corresponding to an original image, are arranged so as to face the photosensitive drum 2. Under a lower surface of the photosensitive drum 2, a developing apparatus 7 is arranged so as to face it. The developing apparatus 7 plays a role in supplying a magnetic toner serving as a developing agent to the toner image formed on the photosensitive drum 2 to develop the toner image. At the other side of the photosensitive drum 2, a transfer charger 8 for transferring the toner image onto the paper sheet, and a removing charger 9 for removing the paper on which the toner image is transferred, from the photosensitive drum 2, are arranged so as to face it.

A paper sheet feed cassette 21 for storing paper sheets P is arranged at a lower portion in the copying machine main body 1. A paper feed roller 22 for feeding paper sheets is arranged at one side of the upper portion of the paper feed cassette 21. The paper sheet P supplied from the paper feed roller 22 is fed along a transfer path 23. Along the transfer path 23, arranged are a feed roller pair 24 for feeding the paper sheet P while sandwiching it therebetween, a resist roller pair 25 for aligning the paper sheet P, the transfer charger 8 and removing charger 9, and a fixing unit 27 for fixing the toner image transferred onto the paper sheet P. In the image forming step, the surface of the photosensitive drum 2 is charged by the electrifying charger 5. Then, an electrostatic latent image corresponding to an original image is formed by the light exposure member 6 on the surface of the photosensitive drum 2. The electrostatic latent image is transferred to the developing apparatus 7 by the rotation of the photosensitive drum 2 and then developed upon supplying a two component developing agent made of a toner and a carrier from the developing apparatus 7, with the result that a toner image is developed.

On the other hand, in this case, a paper sheet P is fed by the rotation of the paper feed roller 22. The paper sheet P is fed by the transfer roller pair 24 while being sandwiched therebetween. The paper sheet P, after being aligned by the resist roller pair 25, is sent between the photosensitive drum 2 and the transfer charger 8, in which the toner image formed on the photosensitive drum 2 is transferred onto the paper P. The paper sheet P having the toner image transferred thereon is removed from the photosensitive drum 2 by the function of the removing charger 9 and further sent to the fixing unit 27. The transferred toner image is fixed onto the paper sheet P in the fixing unit 27 and then discharged into a discharge section (not shown).

Figure 2:
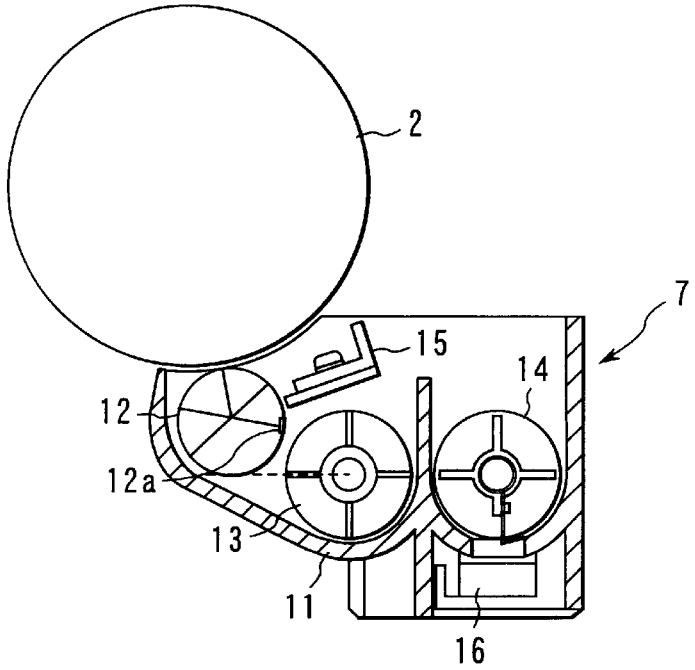
FIG. 2 is a longitudinal sectional view of a developing apparatus.
Figure 3:
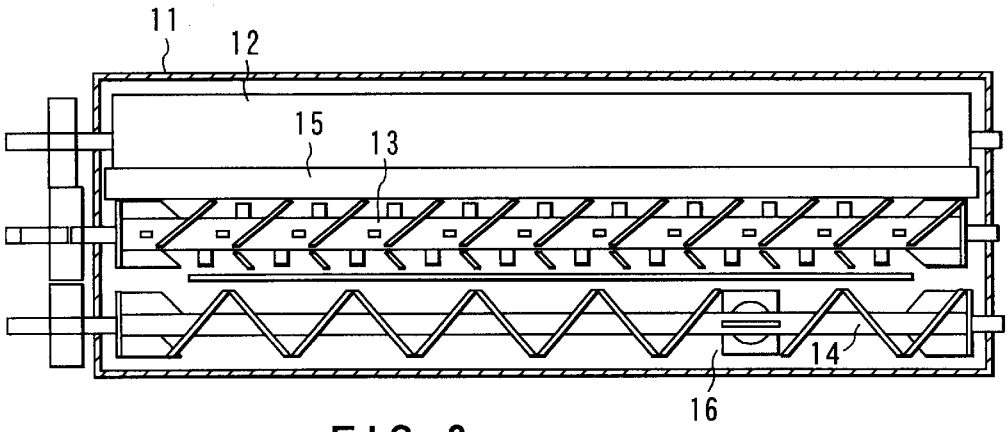
FIG. 3 is a cross sectional view of the developing apparatus.

FIG. 2 is a longitudinal sectional view of the developing apparatus 7 and FIG. 3 is a cross sectional view thereof.

The developing apparatus 7 has a developing casing 11. The two-component developing agent made of a carrier and a toner is stored in the developing casing 11.

In the developing casing 11, arranged are a mag-roller 12 serving as the developing roller, for supplying the developing agent to the photosensitive drum 2, and further, first and second feed mixers 13, 14 for feeding the developing agent while circulating it with stirring.

Furthermore, arranged in the developing casing 11 are a doctor blade 15 for regulating the thickness of the layer formed of the developing agent on the mag roller 12, and a toner concentration sensor 16 for detecting a concentration of the toner in the developing casing 11.

Figure 4:
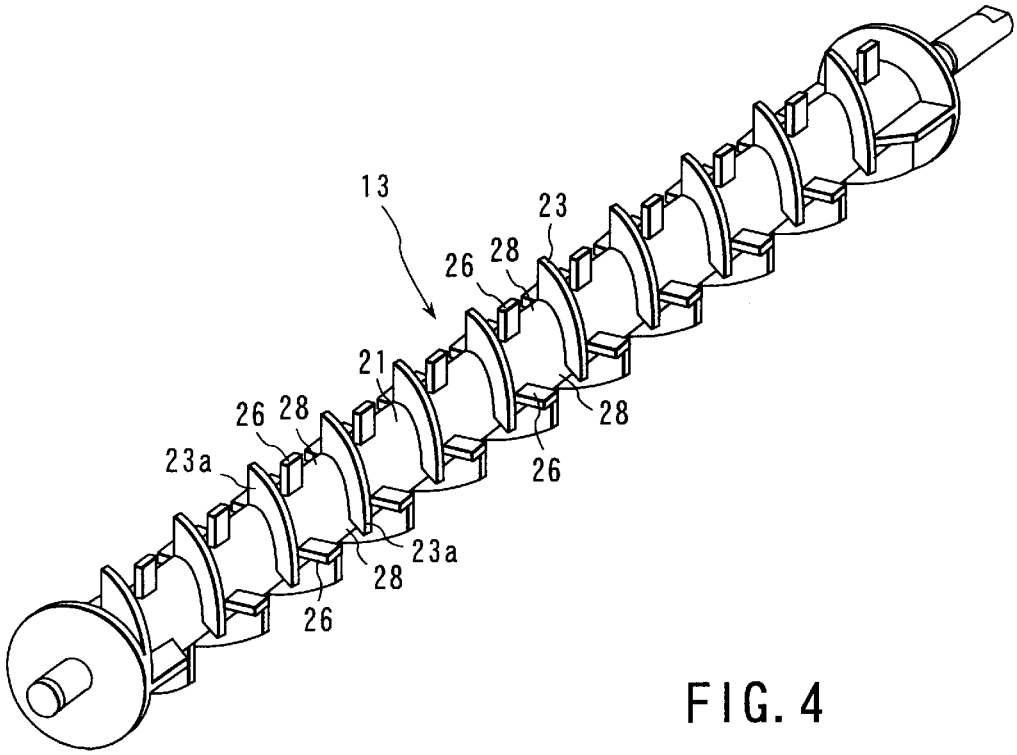
FIG. 4 is a perspective view showing a first feed mixer.
Figure 5:
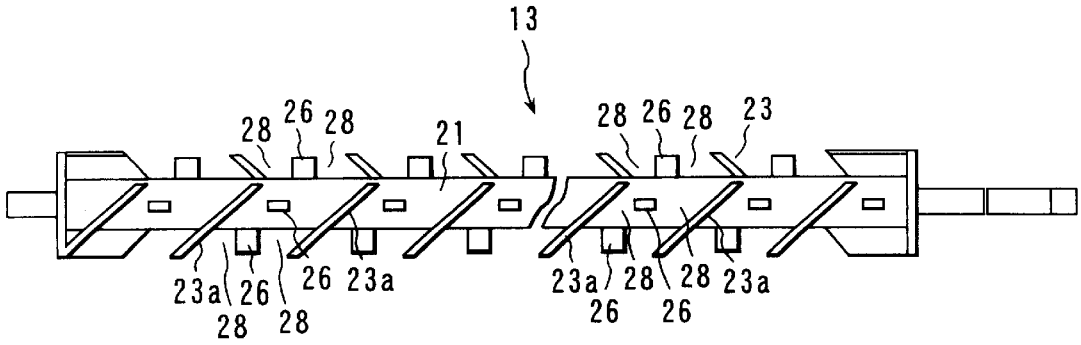
FIG. 5 is a plane view of the first feed mixer.
Figure 6:
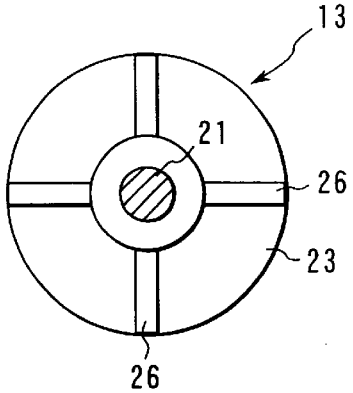
FIG. 6 is a longitudinal sectional view of the first feed mixer.

FIG. 4 is a perspective view of the first feed mixer 13. FIG. 5 is a plan view thereof and FIG. 6 is a longitudinal sectional view thereof.

The first feed mixer 13 has a mixer shaft 21. A blade body 23 for feeding the developing agent while stirring, is formed spirally on the outer periphery of the mixer shaft 21. Furthermore, a plurality of paddles 26, which vertically project from the shaft 21 for scraping the developing agent upwardly to the mag roller 12, are placed respectively between adjacent blade portions 23*a*, 23*a* of the blade body 23 and horizontally and vertically arranged on the outer peripheral surface of the mixer shaft 21 at intervals of 90 degrees.

The width of paddle 26 is made smaller in comparison with a conventional paddle. A space 28 is given between the paddle 26 and each of the blade portions 23*a*, 23*a* in order to reduce a transfer resistance of the developing agent.

Furthermore, a plurality of paddles 26 are arranged along the slope of the blade portions 23*a,* 23*a* of the blade body 23.

In the developing step, the first and second feed mixers 13, 14 are rotated to feed the developing agent in the shaft direction while stirring. The developing agent is circulated by feeding with stirring, and simultaneously, scraped by the paddle 26 and fed to the mag-roller 12. The developing agent fed to the mag-roller 12 is supplied to the electrostatic latent image formed on the photosensitive drum 2 with the aid of rotation of the mag-roller 12.

On the other hand, the developing apparatus 7 is arranged under a lower side of the photosensitive drum 2 to allow the mag-roller 12 to face the lower surface portion of the photosensitive drum 2. This type is called a face-up developing apparatus. In consideration of the fitting position of the doctor blade 15, the fixing positions of the first and second feed mixers 13, 14 must be lowered. As a result, the height difference between the mag-roller 12 and the first and second feed mixers 13, 14 becomes large.

To be more specific, the position of the developing agent attracting pole 12*a* of the mag-roller 12 is higher than the center shafts of the first and second feed mixers, so that the developing agent must be scraped upwardly to a higher position. To attain this, it is known that the most effective way is to attach the scraping paddle to the first feed mixer 13 near the mag-roller 12 in parallel to the mixer shaft 21.

To increase the ability of the paddle for scraping the developing agent, it is also known that the most effective way is to enlarge the area of the paddle by increasing its width size.

However, if the area of the paddle is enlarged by increasing the width size of the paddle, the ability of the paddle for scraping the developing agent is increased, however, the paddle itself imparts a large resistance to feeding the developing agent. It follows that a speed of the developing agent circulating within the developing apparatus 7 decreases. If the circulation speed of the developing agent decreases, a certain part of the toner is intensively consumed in the developing step. As a result, a toner concentration locally decreases. Due to this, the image is not formed uniformly in concentration.

Then, the circulation speed of the developing agent will be explained more specifically with reference to a copy machine printing at a speed of 45 paper sheets per minute.

Figure 7:
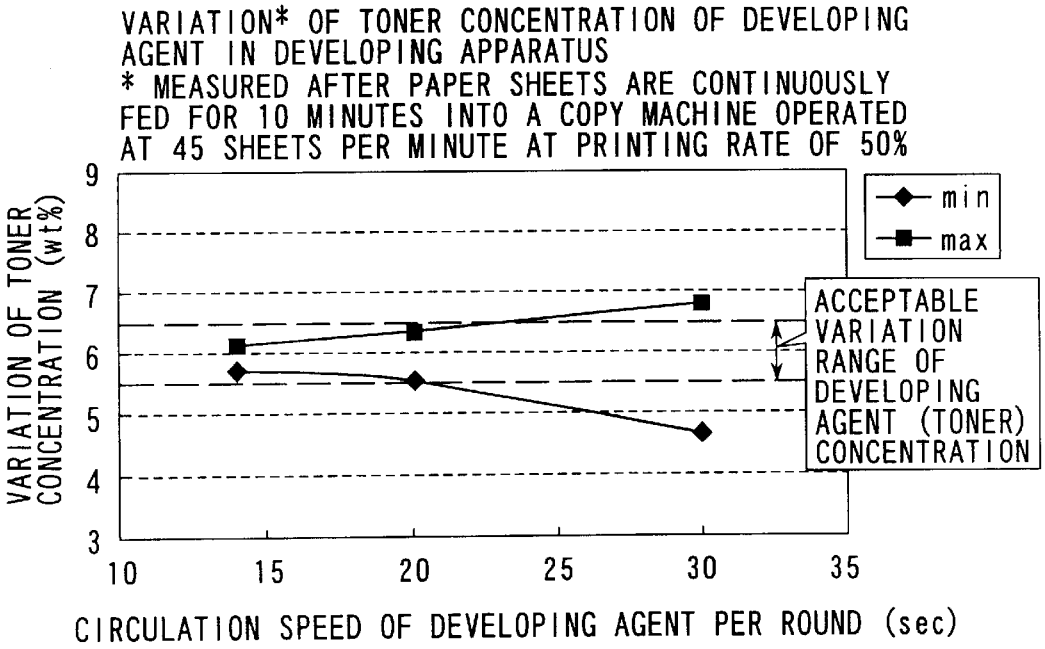
FIG. 7 is a graph showing the relationship between a circulation speed of a developing agent used in a copying machine operated at a rate of 45 sheets per minute and at a printing rate of 50% and variation of toner concentration within the developing machine.

FIG. 7 is a graph showing the variation of toner concentration within the developing apparatus 7 when printing is made continuously with a printing ratio of 50%.

The circulation speed of the developing agent per round is plotted on the horizontal axis and the toner concentration of the developing agent is plotted on the vertical axis.

After printing is made at a printing ratio of 50% for 10 minutes, the toner concentration of the developing agent is measured at six points of the developing apparatus 7. The variation of toner concentration of the developing agent is the difference between the maximum value and the minimum value of the toner concentrations thus measured.

In this case, if the circulation speed of the developing agent decreases to 30 second per round, the variation of toner concentration of the developing agent reaches outside the acceptable range.

Figure 8:
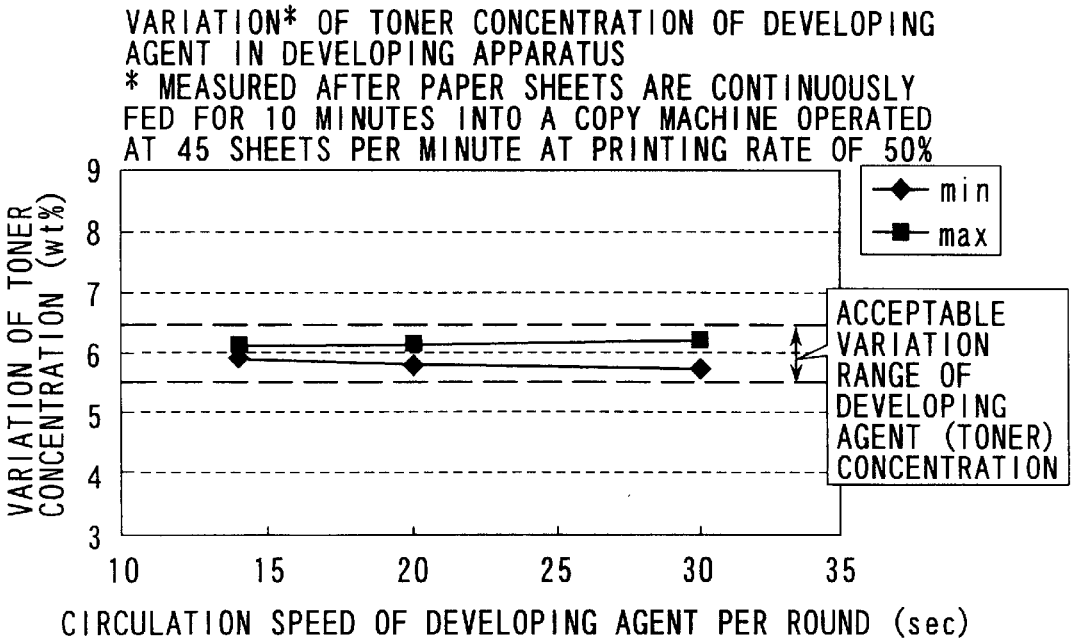
FIG. 8 is a graph showing the relationship between a circulation speed of a developing agent used in a copying machine operated at a rate of 45 sheets per minute and at a printing rate of 10% and variation of toner concentration within the developing machine.

FIG. 8 is a graph showing the variation of toner concentration within the developing apparatus 7 when printing is made continuously at a printing rate of 10%.

In this case, even if the circulation speed of the developing agent is as slow as 30 seconds per round, the variation of toner concentrations of the developing agent is low. Thus, acceptable results are obtained.

As shown in the above, it has been demonstrated that, in the case where the printing ratio is high and the toner consumption is high, the toner concentration of the developing agent significantly varies unless the circulation speed of the developing agent is increased.

From this results, it is easily presumed that, since a high-speed copy machine consumes a larger amount of toner per unit time than a low-speed copy machine, the circulation speed must be increased for the same reason mentioned above.

According to the experiment mentioned above, it is demonstrated that 20 seconds or less of the circulation speed of the developing agent is required per round in the copying machine operated at 45 sheets per minute, in order to stably form an image when printing is made continuously at a printing ratio of 50%. Next, the efficiency of the paddle 26 of the first feed mixer 13 for scraping the developing agent upwardly will be explained in comparison with a conventional case.

Figure 9:
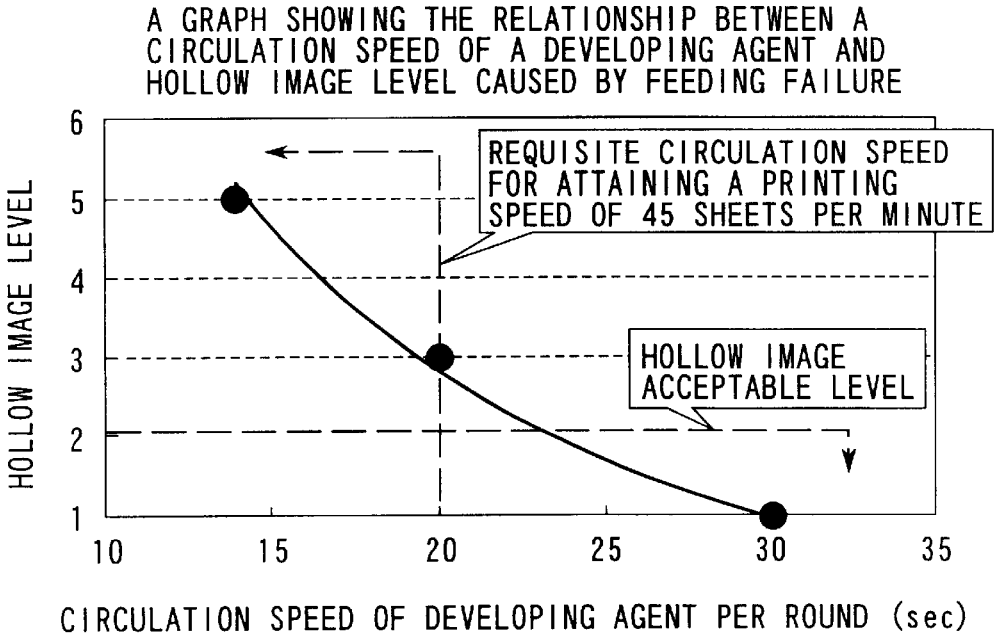
FIG. 9 is a graph showing the relationship between a circulation speed of a developing agent and a hollow image level caused by feeding failure.

FIG. 9 shows the experimental results of the efficiency of developing agent scraping-up function and the developing agent circulation speed in the case of a feed mixer spirally formed only for feeding a conventional developing agent laterally or in the case of a feed mixer improved in the scraping efficiency by vertically fitting a wide paddle in parallel to the mixer shaft.

A circulation speed of each of the feed mixers is plotted on the horizontal axis. The vertical axis shows a level of a hollow image formed by feeding failure, that is, a scraping efficiency of the developing agent.

In the feed mixer spirally formed, the circulation speed of the developing agent is high but the developing agent is not scraped upwardly, with the result that feeding failure occurs resulting in the formation of the hollow image.

Furthermore, in the mixer having a paddle excellent in scraping function the hollow image due to feeding failure is not formed, however, a circulation speed of the developing agent is lowered. As a result, it is impossible for the copy machine to maintain a requisite circulating rate of 45 sheets per minute.

As described above, in the copy machine formed according to the conventional method and operated at a copy speed of 45 sheets per minute, it is impossible to satisfy requirements for both developing agent circulation speed and scraping function.

Figure 10:
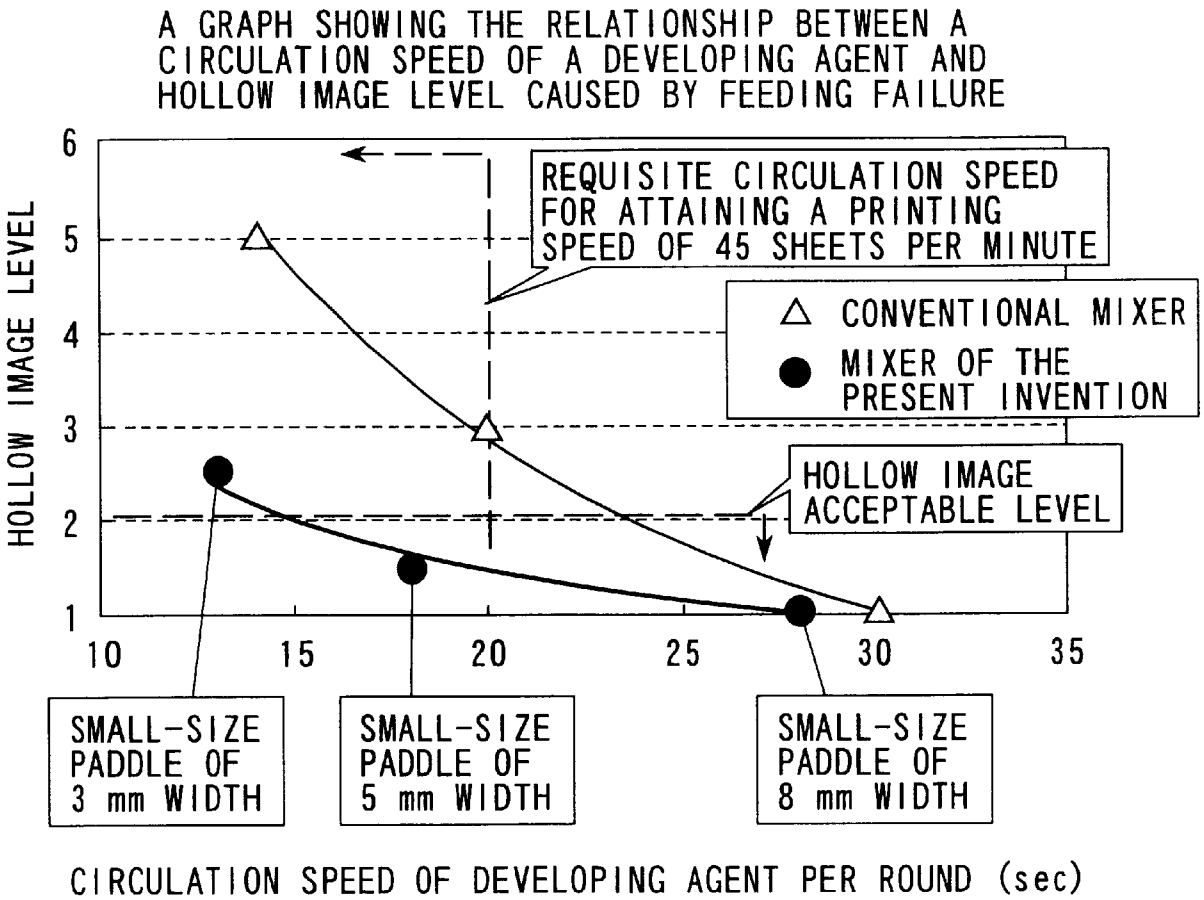
FIG. 10 is a graph showing the relationship between a circulation speed of a developing agent and a hollow image level caused by feeding failure, in comparison with a conventional case.

FIG. 10 shows the experimental results of the developing agent scraping function and the developing agent circulation speed of the feed mixer according to the present invention.

The horizontal axis shows a circulation speed of the developing agent by the first and second feed mixers 13, 14. The vertical axis shows a level of the hollow image due feeding failure caused by insufficient upward scraping of the developing agent.

In FIG. 10, the experiment is performed by changing the width size of the paddle 26 of the first feed mixer 13 of the present invention.

More specifically, experiment was performed by using three types of feed mixers having paddles 26 of 3 mm, 5 mm, and 7 mm in width are used.

In the case where the paddle 26 of 3 mm in width is used, the developing agent circulation speed is high however the scraping function is poor, with the result that feeding failure occurs to form a hollow image. In contrast, in the case where the paddle 26 of 7 mm in width is used, the scraping function is satisfactory however, the developing agent circulation speed is low. Therefore, this machine is not satisfactory for use in printing at 45 sheets per minute.

It was confirmed that the machine having a paddle of 5 mm-width satisfies both functional requirements.

It is confirmed that the balance between both functions is improved as a whole in the feed mixer according to this embodiment, compared to the results of a conventionally-used feed mixer.

From the results, if the developing unit according to this embodiment is applied to the copy machine operated at a copy speed of 45 sheets per minute, the width size of the paddle 26 must be set from 4.5 to 5.5 mm. In this case, the paddle of 5 mm in width was selected.

As explained in the above, according to the present invention, it is possible to satisfy both functions contradicted to each other: one is an ability for scraping the developing agent upwardly and the other is an ability for feeding the developing agent horizontally in parallel to the axis direction, that is, a circulation speed of the developing agent.

Therefore, it is possible to provide an image forming apparatus forming an image without the hollow image due to the poor scraping performance and the non-uniform image in concentration caused by non-uniform delivery of the developing agent (toner) due to a low developing agent circulation speed.

What is claimed is:

1. A developing apparatus comprising:

developing means facing an image carrier for carrying an electrostatic latent image, for developing the electrostatic latent image by supplying a developing agent thereto; and feeding means for feeding the developing agent to the developing means while stirring;

the feeding means comprising:

a rotatable shaft member;

a blade body spirally formed on an outer peripheral surface of the shaft member, for stirring the developing agent in a shaft direction; and a plurality of projections arranged at the outer peripheral surface of the shaft member between tilted blade portions of the blade body, for scraping the developing agent upwardly toward the developing means, the plurality of projections being arranged such that both ends of any one of the plurality of projections are away from the tilted blade portions of the blade body and the plurality of projections are arranged at predetermined intervals over the circumference direction of the shaft member.

2. The developing apparatus according to claim 1, further comprising circulation feeding means for circulating the developing agent while stirring, between the feeding means and the circulation feeding means.

3. The developing apparatus according to claim 1, wherein the projections formed along a circumference of the shaft member are 4 or more, which are arranged at intervals of an angle of 90° or less.

4. The developing apparatus according to claim 1, wherein the projections formed along the circumference of the shaft member are arranged along slope of the blade portions of the blade body.

5. The developing apparatus according to claim 1, wherein the projections are arranged vertically and in parallel to the shaft member.

6. A developing method comprising the steps of:

developing an electrostatic latent image carried on an image carrier by supplying a developing agent by a developing member; and feeding the developing agent by a feeding member to the developing member while stirring, the feeding member comprising:

a rotatable shaft member;

a blade body spirally formed on an outer peripheral surface of the shaft member; and a plurality of projections arranged at the outer peripheral surface of the shaft member between tilted blade portions of the blade body, the plurality of projections arranged such that both ends of any one of the plurality of projections are away from the tilted blade portions of the blade body and the plurality of projections are arranged at predetermined intervals along circumference of the shaft member and scraping the developing agent upwardly, at the same time the developing agent is fed while stirring in a shaft direction by rotation of the blade body.

7. The developing method according to claim 6, wherein the projections formed, along the circumference of the shaft member are 4 or more which are arranged at intervals of an angle of 90° or less.

8. The developing method according to claim 6, wherein the projections formed along the circumference of the shaft member are arranged along slope of the blade portions of the blade body.

9. The developing method according to claim 6, wherein the projections are arranged vertically and in parallel to the shaft member.

10. An image forming apparatus comprising:

image forming means for forming an electrostatic latent image corresponding to an image data on an image carrier;

developing means arranged under the image carrier for developing the electrostatic latent image formed by the image forming means by supplying a developing agent thereto; and transfer means for transferring a developing agent image developed by the developing means to a medium, the developing means comprising:

supply means arranged so as to face the image carrier for supplying the developing agent to the electrostatic latent image, thereby developing the electrostatic latent image;

feeding means for feeding the developing agent to the supply means while stirring the developing agent;

the feeding means comprising:

a rotable shaft member;

a blade body spirally formed on an outer peripheral surface of the shaft member, for stirring the developing agent in a shaft direction; and a plurality of projections arranged at the outer peripheral surface of the shaft member between tilted blade portions of the blade body, for scraping the developing agent upwardly toward the developing means, the plurality of projections being arranged such that both ends of any one of the plurality of projections are away from the tilted blade portions of the blade body and the plurality of projections are arranged at predetermined intervals along circumference of the shaft member.

11. The image forming apparatus according to claim 10, further comprising circulation feeding means for circulating the developing agent while stirring between the feeding means and the circulation feeding means.

12. The image forming apparatus according to claim 10, wherein the projections formed around the circumference direction of the shaft member are 4 or more, which are arranged at intervals of an angle of 90° or less.

13. The image forming apparatus according to claim 10, wherein the projections formed along the circumference of the shaft member are arranged along slope of the blade portions of the blade body.

14. The image forming apparatus according to claim 10, wherein the projections are arranged vertically and in parallel to the shaft member.

15. A developing apparatus comprising:

a developing unit, including a developing roller, facing an image carrier for carrying an electrostatic latent image, that develops the electrostatic latent image by supplying a developing agent thereto;

a feeding mixer that feeds the developing agent to the developing unit while stirring;

the feeding mixer comprising:

a rotatable shaft member;

a blade body spirally formed on an outer peripheral surface of the shaft member, for stirring the developing agent in a shaft direction; and a plurality of projections arranged at the outer peripheral surface of the shaft member between tilted blade portions of the blade body, for scraping the developing agent upwardly toward the developing unit, the plurality of projections being arranged such that both ends of any one of the plurality of projections are away from the tilted blade portions of the blade body and the plurality of projections are arranged at predetermined intervals over the circumference direction of the shaft member.

* * * * *